US008188399B2

(12) United States Patent
Chung et al.

(10) Patent No.: US 8,188,399 B2
(45) Date of Patent: May 29, 2012

(54) FITTING A LIGHT GUIDE SHEET TO A KEYPAD USING PROTRUSIONS

(75) Inventors: Muh Fong Chung, Bukit Jambul (MY); Choon Guan Ko, Sungai Dua (MY); Yew Huat Chow, Bukit Mertajam (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 341 days.

(21) Appl. No.: 12/576,162

(22) Filed: Oct. 8, 2009

(65) Prior Publication Data

US 2011/0083951 A1 Apr. 14, 2011

(51) Int. Cl.
*H01H 1/10* (2006.01)

(52) U.S. Cl. ..... 200/512; 362/23; 200/314

(58) Field of Classification Search ..... 200/512
See application file for complete search history.

(56) References Cited

U.S. PATENT DOCUMENTS

| | | | | |
|---|---|---|---|---|
| 7,503,683 | B2 | 3/2009 | Liu | |
| 2001/0016434 | A1 | 8/2001 | Christensen et al. | |
| 2008/0266863 | A1 | 10/2008 | Rinko et al. | |
| 2009/0128372 | A1 | 5/2009 | Wu et al. | |
| 2011/0073454 | A1 * | 3/2011 | Chen et al. | 200/5 A |

FOREIGN PATENT DOCUMENTS

EP 2003669 A1 12/2008

* cited by examiner

*Primary Examiner* — Renee S Luebke
*Assistant Examiner* — Lheiren Mae Caroc

(57) ABSTRACT

In an embodiment, the invention provides a keypad assembly comprising a keypad, a light guide sheet, a dome sheet, and a board. The keypad comprises at least one protrusion and at least one rib. The light guide sheet has openings that are smaller than a first portion of the at least one protrusion. The dome sheet and the board have openings that are larger than a first portion of the at least one protrusion. The at least one protrusion is compressible such that the first portion of the at least one protrusion is extendable through the openings in the light guide sheet, the dome sheet and the board. The at least one rib physically contacts at least a portion of the light guide sheet.

18 Claims, 7 Drawing Sheets

FITTING A LIGHT GUIDE SHEET TO A KEYPAD USING PROTRUSIONS

BACKGROUND

Backlight modules are often used in electronic products such as mobile phones and personal digital assistants. Often these backlight modules are installed in keypad assemblies to enable users of mobile phones and personal digital assistants to see the keypads in low light environments.

Light guide sheets are often installed in keypad assemblies to provide backlighting for a keypad. Usually light from one or more LEDs is transmitted into a light guide sheet at the periphery of the light guide sheet. After light from the LEDs is transmitted into the light guide sheet, light is reflected internally in the light guide sheet. A portion of the light transmitted into the light guide sheet leaves a top surface of the light guide sheet. The light leaving the top surface of the light guide sheet illuminates the keypad is directly above the top surface of the light guide sheet.

Securing a light guide sheet to a PCB (Printed Circuit Board) or a dome sheet can be problematic. One method used to secure a light guide sheet to a PCB or a dome sheet is to use adhesive to "stick" the light guide sheet to a PCB or a dome sheet. This technique does not always allow the light guide sheet to stay flat on a PCB or a dome sheet. For example, if the distance from an edge of a metal dome to an edge of a secured light guide sheet is too short, tension may be created at an edge of the light guide sheet. Due to the tension created by the metal dome and the secured light guide sheet at an edge of the light guide, the light guide sheet may separate or "lift" from the PCB or the dome sheet. In addition, if the light guide sheet is lifted along the side where LEDs are positioned, the amount of light transmitted into the light guide sheet may be reduced.

Another problem that may occur when the distance from a metal dome to an edge of a secured light guide sheet is too short is that a metal dome may be lifted from a PCB. In this example, the adhesive applied may be too strong. As a result, the metal dome will be lifted from the PCB while the light guide sheet remains secure.

DETAILED DESCRIPTION

The drawings and description, in general, disclose a keypad assembly containing a keypad, a light guide sheet, a dome sheet and a board. The keypad contains one or more ribs and one or more protrusions. The light guide sheet, the dome sheet and the board each contain one or more openings. The one or more openings of the light guide sheet, the dome sheet and the board each receive the one or more protrusions. As a result of receiving the one or more protrusions, the light guide sheet is secured to the keypad as part of the keypad assembly.

Adhesive is not necessary to secure the light guide sheet, the dome sheet and the board to the keypad as part of the keypad assembly. In addition, the one or more ribs secure the light guide sheet along the side that contains LEDs. Securing a rib to the light guide sheet along the side that contains the LEDs enables the light guide sheet to be aligned with the LEDs for improved transmission of light from the LEDs into the light guide sheet.

Figure 1:
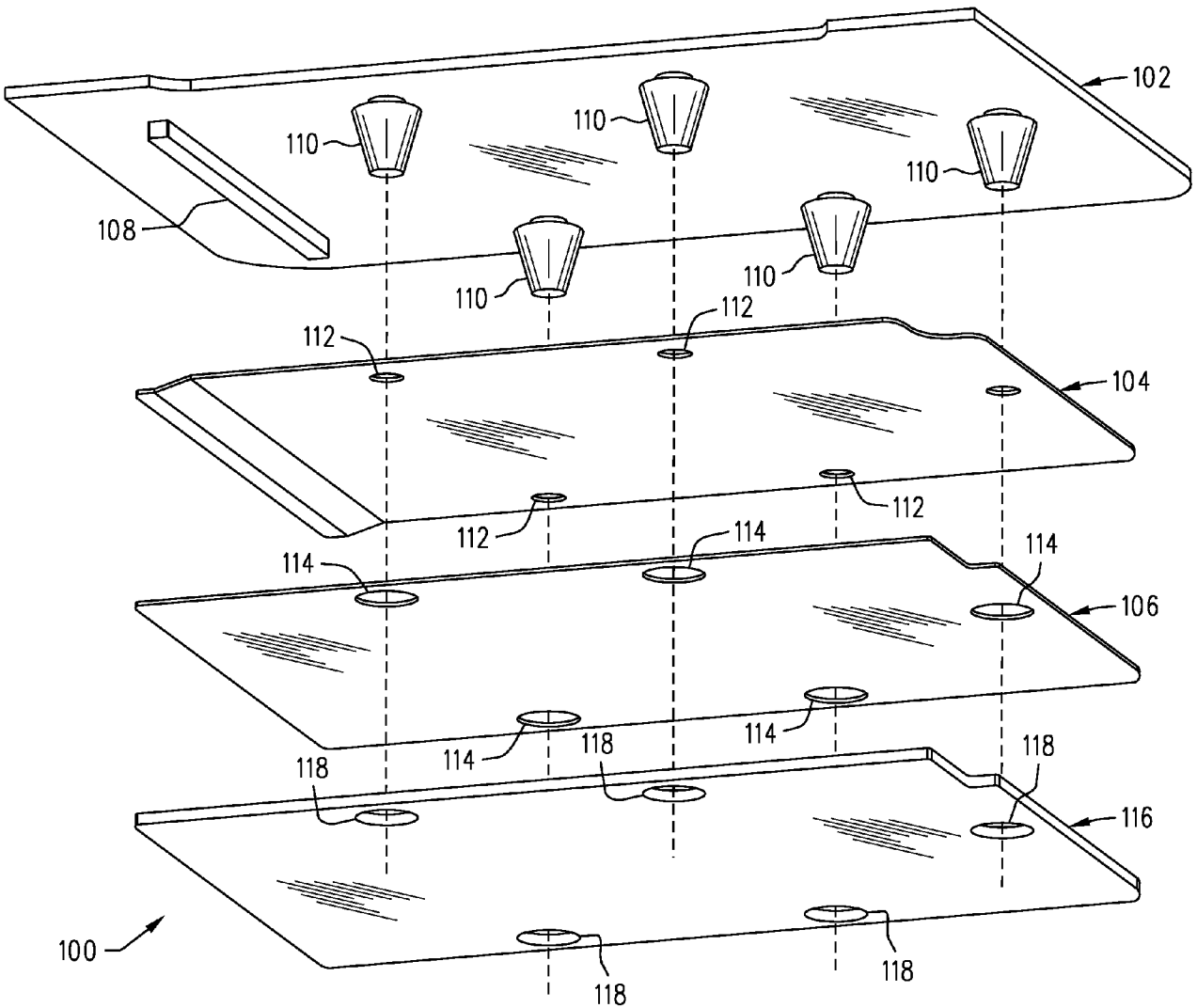
FIG. 1 is an exploded isometric view of a keypad assembly in accordance with an exemplary embodiment of the invention.

FIG. 1 is an exploded isometric view of a keypad assembly in accordance with an exemplary embodiment of the invention. In this first exemplary embodiment, the keypad assembly 100 comprises a keypad 102, a light guide sheet 104, a dome sheet 106 and a board 116. In this exemplary embodiment, the keypad 102 comprises a rib 108 and five protrusions 110. In this example, the protrusions 110 are tapered cylinders. However, the protrusions may have other shapes. For example, the protrusions may have a length with a square or rectangular shape.

The light guide sheet 104 comprises five openings 112. The dome sheet 106 comprises five openings 114 and one or more dome plungers (not shown in this Figure). The board 116 comprises five openings 118 and one or more domes (not shown in this Figure). The board may be a PCB (Printed Circuit Board) or a FPCB (Flexible Printed Circuit Board) for example. In this example, the openings 112, 114 and 118 have a circular periphery. However, the openings 112, 114 and 118 may have other peripheries. For example, the openings may have a rectangular or square periphery.

The openings 112, 114 and 118 are positioned such that the five protrusions 110 may be pressed through the five openings 112, 114 and 118 on the light guide sheet 104, the dome sheet 106 and the board 116 respectively. The five protrusions in this example are compressible with respect to the peripheries of the openings 112.

One method of assembling the keypad assembly 100 is to press the five protrusions 110 through the five openings 112 on the light guide sheet 104. The pressing of the light guide sheet 104 onto the five protrusions on the keypad 102 may be done manually or by using a pressing jig for example.

Figure 2:
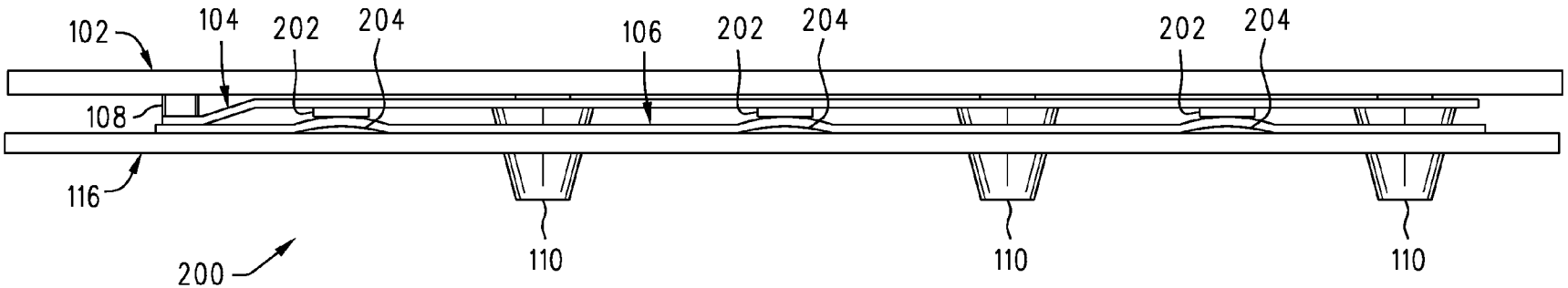
FIG. 2 is a side view of a keypad assembly in accordance with an exemplary embodiment of the invention.

FIG. 2 is a side view of a keypad assembly 200 in accordance with an exemplary embodiment of the invention. This exemplary embodiment of the invention shows an assembled keypad assembly 200. The assembled keypad assembly 200 includes a keypad 102, a light guide sheet 104, a dome sheet 106 and a board 116. The keypad 102 includes a rib 108 and protrusions 110. The dome sheet 106 includes dome plungers 202. The board 116 includes domes 204. The domes 204 may be metal domes for example.

In this exemplary embodiment, the rib 108 secures an edge of the light guide sheet 104 and the dome sheet 106 against the board 116. The rib 108 secures an edge of the light guide sheet 104 and the dome sheet 106 against the board 116 by use of a pressure fit created by pressing the is protrusions 110 through the openings 112.

Figure 3:
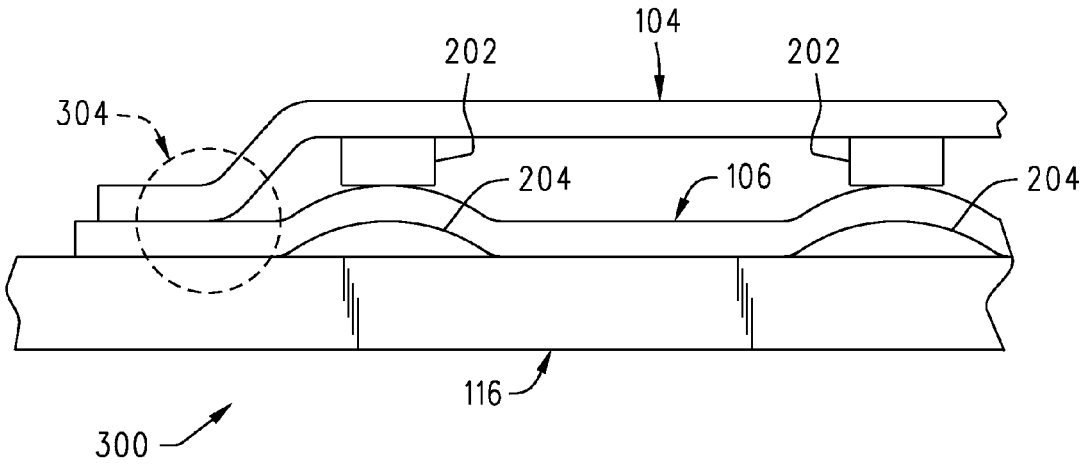
FIG. 3 is a side view of a keypad assembly in accordance with an exemplary embodiment of the invention.

FIG. 3 is a diagram illustrating a light guide sheet 104 and a dome sheet 106 secured to a board 116. At an edge 304 of a keypad assembly 300 in this diagram, a dome sheet 106 is adhered or "glued" to the board 116. The light guide sheet 104 is adhered to the dome sheet 106. The domes 204 and the dome plungers 202 exert a force against the dome sheet 106 and the light guide sheet 104. The force exerted by the domes 204 and the dome plungers 202 against the dome sheet 106 and the light guide sheet 104 may cause the dome sheet 106 to separate from the board 116 as shown in FIG. 4.

Figure 4:
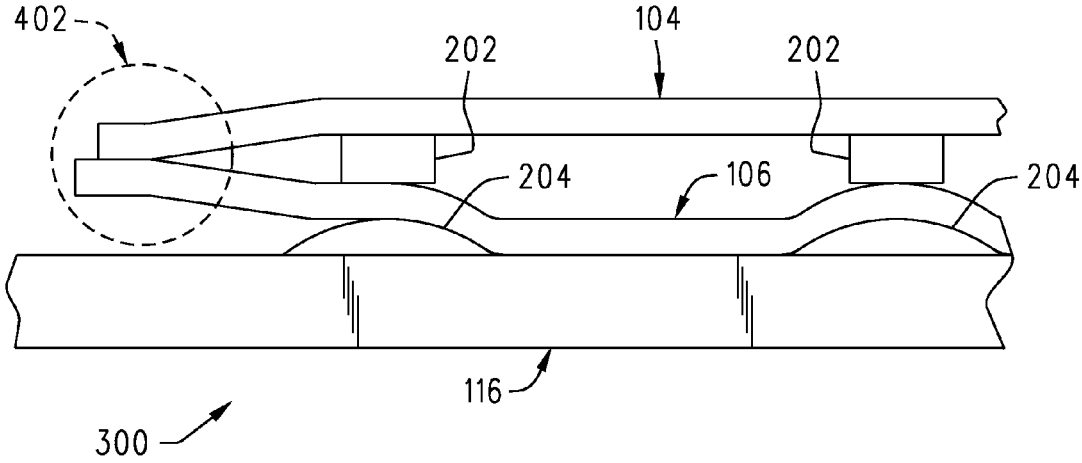
FIG. 4 is a side view of a keypad assembly in accordance with an exemplary embodiment of the invention.

FIG. 4 is a diagram illustrating a light guide sheet 104 and a dome sheet 106 separated at the edge of a board 116. The area 402 shows an edge of the light guide sheet 104 and an edge of the dome sheet 106 separated from the board 116. The force exerted by the domes 204 and the dome plungers 202 against the dome sheet 106 and the light guide sheet 104 may cause the dome sheet 106 and the light guide sheet 104 to separate from the board 116. It is also possible for only the light guide sheet 104 to separate from the dome sheet 106. In a case where the light sheet 104 and the dome sheet 106 do not separate from the board 116, it is possible for a to dome 204 to be separated from the board 116.

Figure 5:
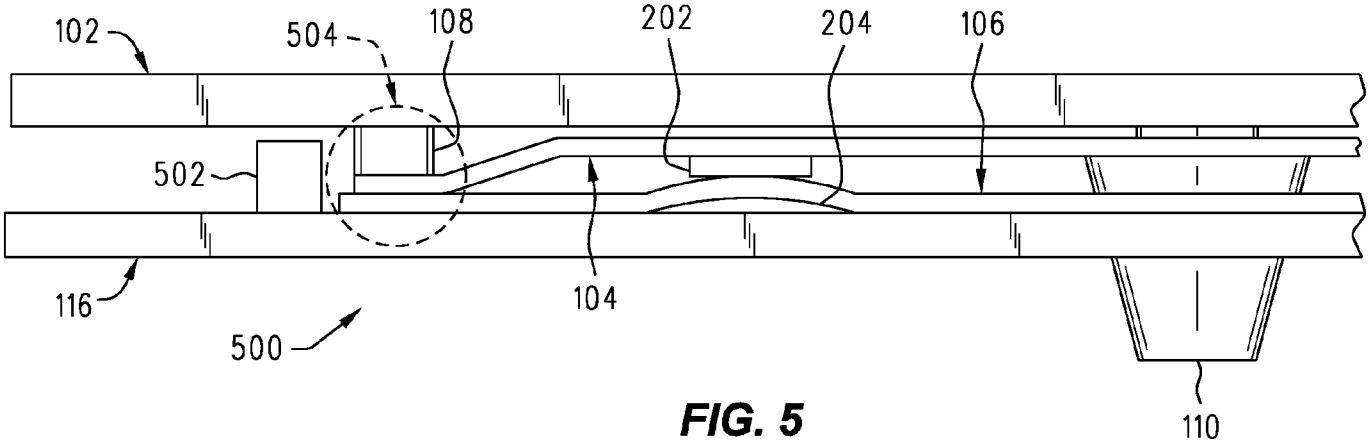
FIG. 5 is a side view of a keypad assembly including an LED in accordance with an embodiment of the invention.

FIG. 5 is a side view of a keypad assembly 500 that includes an LED in accordance with an embodiment of the invention. In this embodiment, as shown in circle 504, a rib 108 applies pressure to an edge of light guide sheet 104 and to an edge of dome sheet 106. The pressure exerted on these edges forces the edges to abut the board 116. The pressure exerted on these edges is created when the protrusions 110 are received by the openings 112 in the light guide sheet 104. The protrusions 110 are also received by openings 114, 118 in the dome sheet 106 and the board 116 respectively. No adhesive is necessary to secure the edge of the light guide sheet 104 and the edge of the dome sheet 106 to the board 116.

Figure 6:
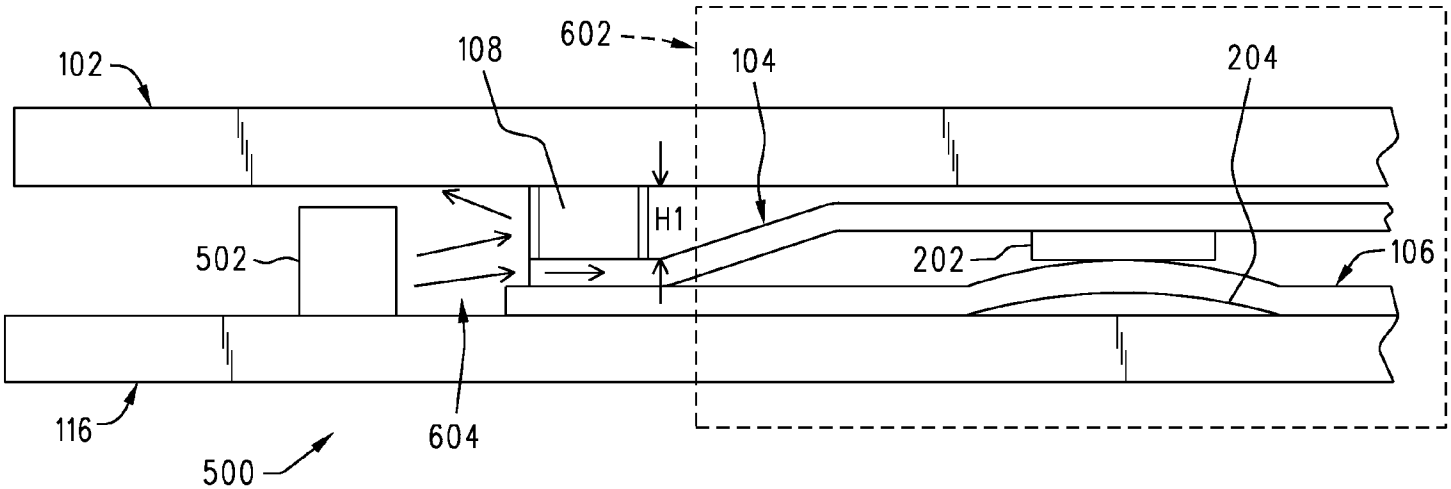
FIG. 6 is a side view of a keypad assembly including an LED illustrating the transmission of light in accordance with an embodiment of the invention.

FIG. 6 is a side view of a keypad assembly 500 including an LED 502 illustrating the transmission of light 604 into the light guide sheet 104 in accordance with an embodiment of the invention. Light 604 emitted from LED 502 enters the light guide 104. Light 604 emitted from LED 502 is also absorbed or reflected by rib 108. In one embodiment, the rib 108 may be painted black to absorb light 604. It is an advantage for the rib 108 to block light 604 from entering the illuminated zone 602.

If the rib 108 was not included as part of keypad assembly 500 or if the rib 108 was transparent to light, light may enter the illuminated zone 602 creating a "hot spot". A hot spot is an area on the keypad 102 that is more brightly illuminated than other areas of the keypad 102. A uniformly illuminated keypad is more desirable than a keypad having hot spots. The rib 108 reduces the intensity of hot spots at the edges of the keypad assembly 500.

In addition to improving the uniformity of illumination on the keypad 102, the rib 108 aligns the position of an edge of the light guide sheet 104 relative to the LED 502. Aligning an edge of the light guide sheet 104 relative to the LED 502 allows more light 604 transmitted from the LED 502 to enter the light guide sheet 104. The height H1 of the rib 108 may be selected to optimize the amount of light 604 entering the light guide sheet 104.

Figure 7:
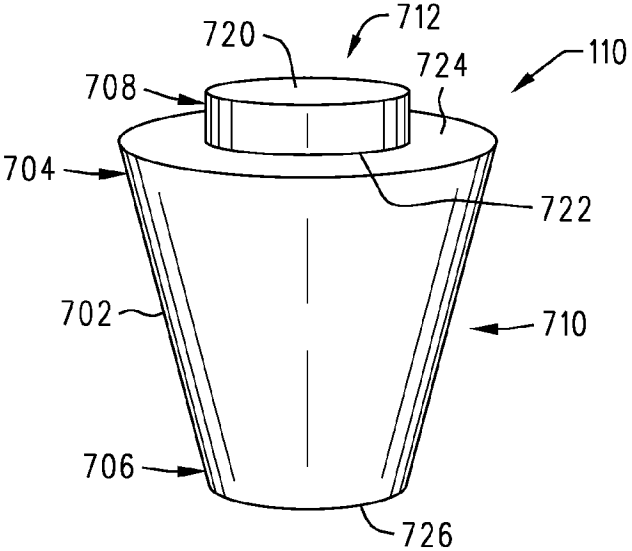
FIG. 7 is an isometric view of a protrusion in accordance with an embodiment of the invention.

FIG. 7 is an isometric view of a protrusion 110 in accordance with an embodiment of the invention. In this embodiment, the protrusion 110 has a first portion 704, a second portion 706 and a third portion 708. In this example, the protrusion is tapered 702. The protrusion, in this example, is compressible with respect to the peripheries of the openings 112 in the light guide sheet 104. In this embodiment the openings 112 in the light guide sheet 104 are smaller than the first portion 704 of the protrusion 110. In this embodiment, the openings 114 and 118 in the dome sheet 106 and the board 116 respectively are larger than the first portion 704 of the protrusion 110. The second portion 706 of the protrusion is smaller than the first portion 704 of the protrusion 110. The third portion 708 of the protrusion 110 is smaller than the first portion 704 of the protrusion 110.

The protrusion 110 shown in FIG. 7 further comprises a first shaft 712 and a second shaft 710. The first shaft 712 has a first end 720 and a second end 722. The second shaft 710 has a first end 724 and a second end 726.

Figure 8:
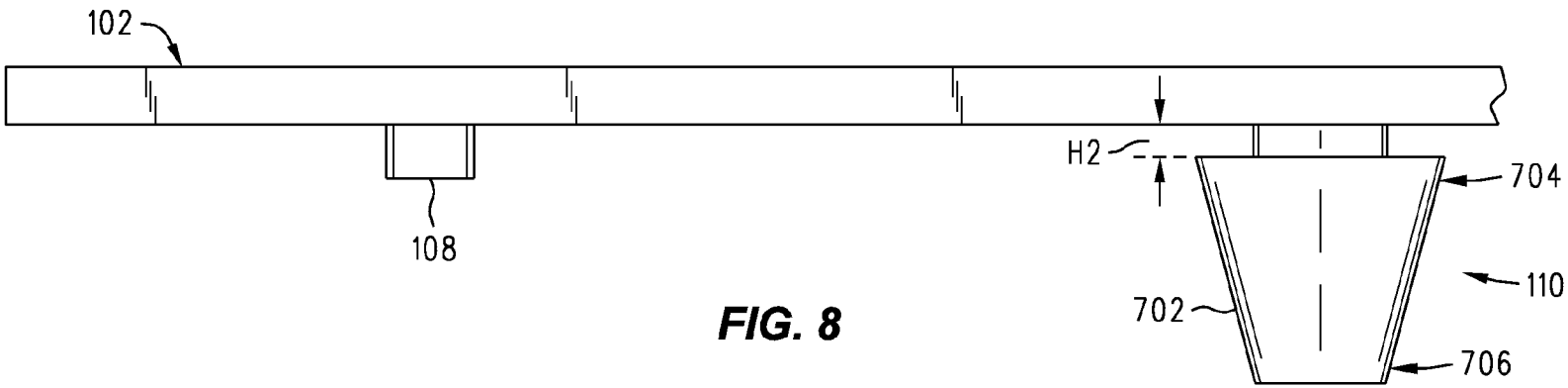
FIG. 8 is a side view of a protrusion on a keypad in accordance with an embodiment of the invention.

FIG. 8 is a side view of a protrusion 110 on a keypad 102 in accordance with an embodiment of the invention. In this embodiment, a distance with a length H2 is created between the first portion 704 of the to protrusion 110 and the keypad 102. The distance with a length H2 is created to allow a light guide sheet 104 (not shown in FIG. 8) to rest on the first portion 704 of the protrusion 110.

Figure 9:
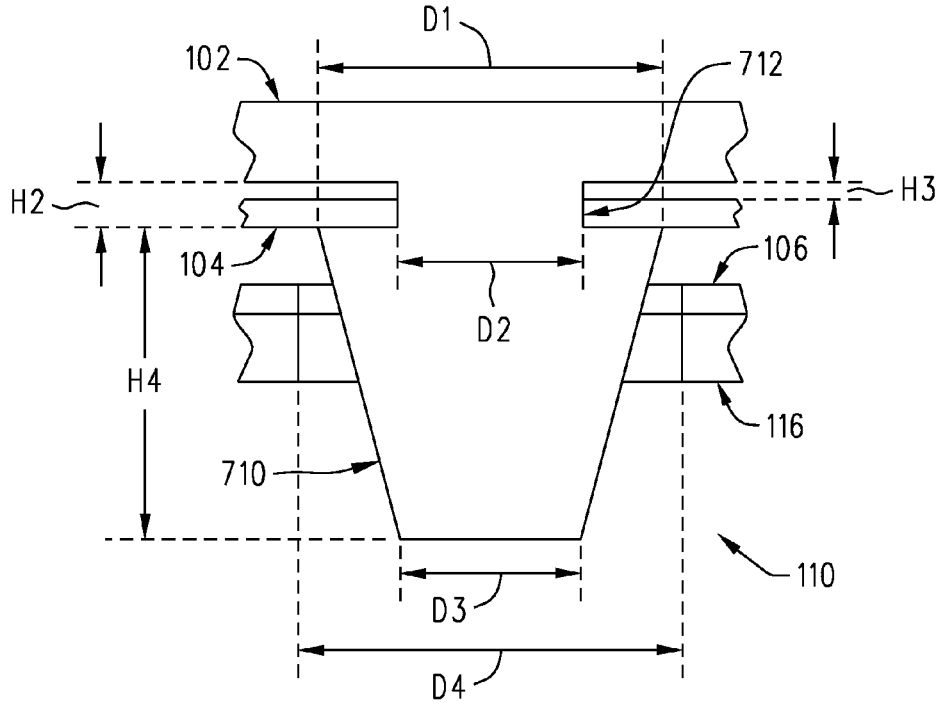
FIG. 9 is a cross-sectional view of a keypad assembly in accordance with an embodiment of the invention.

FIG. 9 is a cross-sectional view of a keypad assembly in accordance with an embodiment of the invention. The protrusion 110 shown in FIG. 9 comprises a first shaft 712 and a second shaft 710. The first shaft 712 has a length H2. The first end 720 of the first shaft 712 is physically connected to the keypad 102. The second end 722 of the first shaft 712 is physically connected to the second shaft 710. The first shaft 712 has, in this embodiment, a cylindrical shape with an approximately constant diameter D2. However, in other embodiments, the first shaft 712 may have different shapes. In this embodiment, the first shaft 712 is compressible with respect to the openings 112 in the light guide sheet 104. In this embodiment, the first shaft 712 may or may not make contact with the periphery of the openings 112 in the light guide sheet 104.

The second shaft 710 has a cylindrical shape with a first end 724 and a second end 726. The second shaft 710 has a length H4. The first end 724 of the second shaft 710 has a diameter D1. The second end 726 of the second shaft 710 has a diameter D3. The second shaft 710 tapers from the first end 724 to the second end 726. The second shaft 710 has, in this embodiment, a cylindrical shape. However, in other embodiments, the second shaft 710 may have different shapes. In this embodiment, the second shaft 710 is compressible with respect to the openings 112 in the light guide sheet 104.

In the embodiment shown in FIG. 9, a space H3 is maintained between the keypad 102 and the light guide sheet 104. The light guide sheet 104, in this example, makes contact on the second shaft 710 of the protrusion 110. The dome sheet 106 makes contact with the board 116. In this embodiment, the second shaft 710 of the protrusion 110 does not make is contact with the periphery of the openings 114 and 116 in the dome sheet 106 and the board 116 respectively. The openings 114 and 116, in this example, have a diameter D4. The diameter D4 of the openings 114 and 116 is larger than the diameter D1 of the first end 724 of the second shaft 710.

Figure 10:
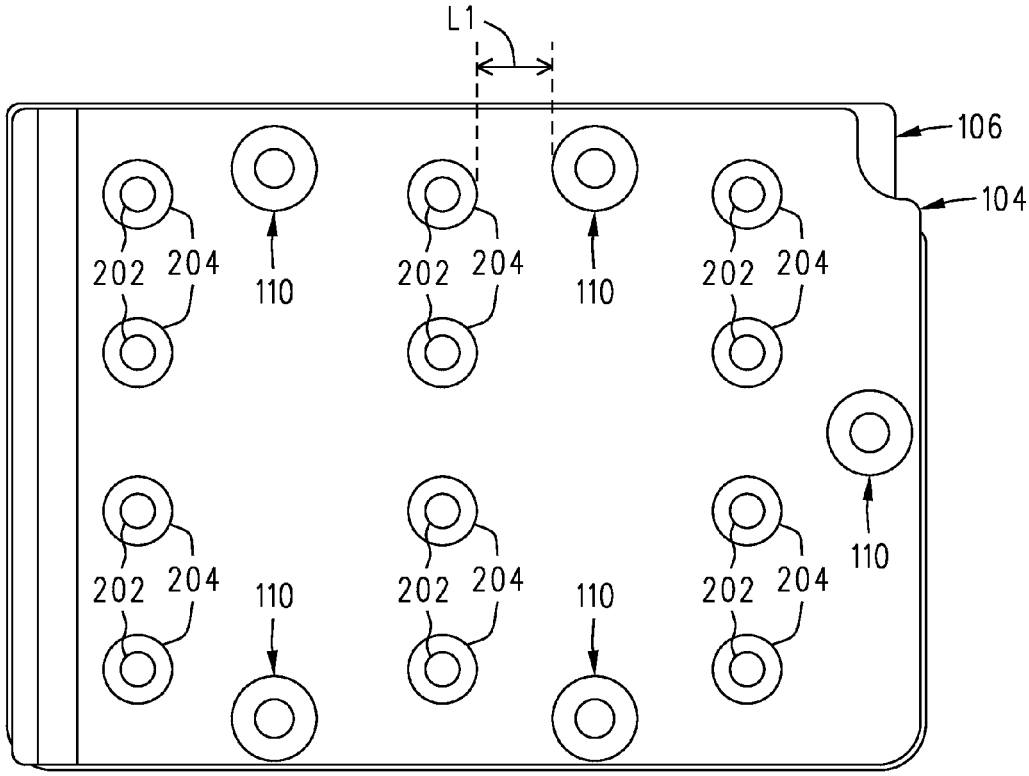
FIG. 10 is a plan view of a keypad assembly in accordance with an embodiment of the invention.

FIG. 10 is a plan view of a keypad assembly in accordance with an embodiment of the invention. FIG. 10 shows the edges of the dome plungers 202, the edges of the domes 204 and the edges of the protrusions 110. In this embodiment, the distance L1 from any edge of the domes 204 to any outer edge of the protrusions 110 should be no shorter than approximately 3 mm. Keeping the distance L1 no shorter than approximately 3 mm from any edge of the domes 204 to any outer edge of the protrusions 110 reduces mechanical stress in the keypad assembly 500.

Figure 11:
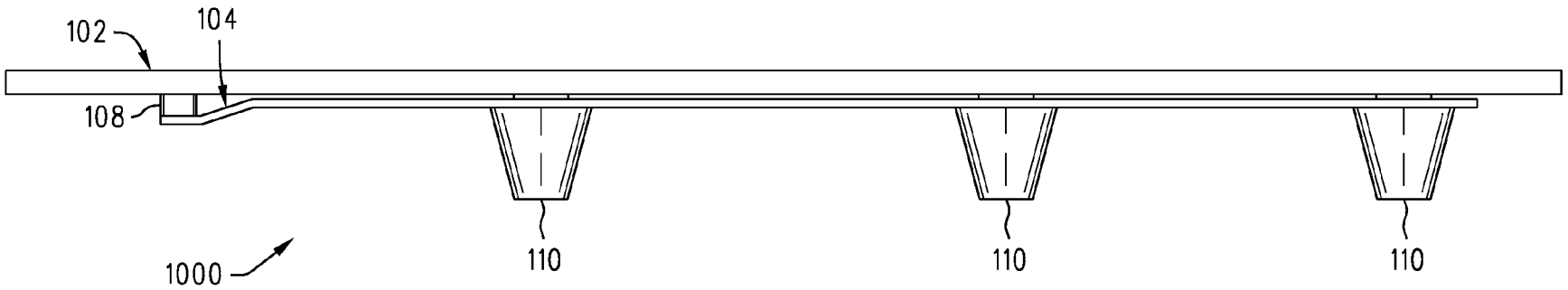
FIG. 11 is a side view of a keypad assembly in accordance with an exemplary embodiment of the invention.

FIG. 11 is a side view of a keypad assembly in accordance with an exemplary embodiment of the invention. In this embodiment, a keypad 102 with protrusions 110 is pressed through a light guide sheet 104. The rib 108 exerts pressure on the light guide sheet 104 securing the light guide sheet 104 to the keypad 102. The openings 112 (not shown) in the light guide sheet 104 are smaller than the first portion 704 of the protrusions 110.

The foregoing description has been presented for purposes of illustration and description. It is not intended to be exhaustive or to limit the invention to the precise form disclosed, and other modifications and variations may be possible in light of the above teachings. The exemplary embodiments were chosen and described in order to best explain the applicable principles and their practical application to thereby enable others skilled in the art to best utilize various embodiments and various modifications as are suited to the particular use contemplated. It is intended that the appended claims be construed to include other alternative embodiments except insofar as limited by the prior art.

What is claimed is:

1. A keypad assembly comprising:

a keypad comprising at least one protrusion having a first portion and at least one rib;

a light guide sheet comprising at least one opening that is smaller than the first portion of the at least one protrusion;

a dome sheet comprising at least one dome plunger and at least one opening that is larger than the first portion of the at least one protrusion;

a board comprising at least one dome and at least one opening that is larger than the first portion of the at least one protrusion;

wherein a portion of the at least one rib physically contacts at least a portion of the light guide sheet;

wherein the at least one protrusion is compressible such that the first portion of the at least one protrusion is extendable through the at least one opening in the light guide sheet, the dome sheet and the board.

2. The keypad assembly as in claim 1 wherein the board is selected from a group consisting of a PCB (Printed Circuit Board) and a FPCB (Flexible Printed Circuit Board).

3. The keypad assembly as in claim 1 wherein the at least one opening in the dome sheet is larger than the at least one opening in the board.

4. The keypad assembly as in claim 1 wherein the at least one protrusion comprises:

a first shaft having a substantially cylindrical shape with a first end, a second end and a length, the substantially cylindrical shape having a substantially constant diameter;

a second shaft having a substantially tapered cylindrical shape with a first end, a second end and a length, wherein a diameter of the second shaft is tapered along the length of the second shaft starting at the first end of the second shaft and ending at the second end of the second shaft;

wherein the diameter of the first shaft is smaller than the diameter of the second shaft at the first end of the second shaft;

wherein the first end of the first shaft is attached to the keypad;

wherein the second end of the first shaft is attached to the first end of the second shaft;

wherein the at least one opening in the light guide sheet, the dome sheet and the board are circular.

5. The keypad assembly as in claim 4 wherein material used to make the first shaft is selected from a group consisting of silicone rubber and epoxy.

6. The keypad assembly as in claim 4 wherein material used to make the second shaft is selected from a group consisting of silicone rubber and epoxy.

7. The keypad assembly as in claim 1 wherein material used to make the at least one protrusion is selected from a group consisting of silicone rubber and epoxy.

8. The keypad assembly as in claim 1 wherein a distance of approximately 3 millimeters or more is maintained between an edge of the at least one protrusion and an edge of the at least one dome.

9. The keypad assembly as in claim 1 wherein the at least one dome is a metal dome.

10. The keypad assembly as in claim 1 wherein at least one light source is attached to the board;

wherein a first portion of light from the at least one light source is transmitted into the light guide sheet;

wherein a second portion of light from the at least one light source is blocked by the at least one rib.

11. A keypad assembly comprising:

a keypad comprising at least four protrusions having first portions and at least one rib;

a light guide sheet comprising at least four openings that are smaller than the first portions of the at least four protrusions;

a dome sheet comprising at least one dome plunger and at least four openings that are larger than the first portions of the at least four protrusions;

a board comprising at least one dome and at least four openings that are larger than the first portions of the at least four protrusions;

wherein a portion of the at least one rib physically contacts at least a portion of the light guide sheet;

wherein the at least four protrusions are compressible such that the first portions of the at least four protrusions are extendable through the at least four openings in the light guide sheet, the dome sheet and the board.

12. A method of assembling a keypad to a light guide sheet comprising:

pressing an at least one protrusion on a keypad through an at least one opening in a light guide sheet;

wherein the at least one protrusion comprises a first shaft having a substantially cylindrical shape with a first end, a second end and a length, the substantially cylindrical shape having a substantially constant diameter;

wherein the at least one protrusion further comprises a second shaft having a substantially tapered cylindrical shape with a first end, a second end and a length, wherein a diameter of the second shaft is tapered along the length of the second shaft starting at the first end of the second shaft and ending at the second end of the second shaft;

wherein the diameter of the first shaft is smaller than the diameter of the second shaft at the first end of the second shaft;

wherein the first end of the first shaft is attached to the keypad;

wherein the second end of the first shaft is attached to the first end of the second shaft;

wherein the at least one opening in the light guide sheet is circular;

wherein the keypad has at least one rib;

wherein the at least one rib contacts a portion of the light guide sheet; and wherein the at least one protrusion is compressible such that a first portion of the at least one protrusion is extendable through the at least one opening in the light guide sheet.

13. The method as in claim 12 wherein material used to make the first shaft is selected from a group consisting of silicone rubber and epoxy.

14. The method as in claim 12 wherein material used to make the second shaft is selected from a group consisting of silicone rubber and epoxy.

15. The method as in claim 12 wherein pressing the at least one protrusion through the at least one opening in the light guide sheet is done manually.

16. The method as in claim 12 wherein pressing the at least one protrusion through the at least one opening in the light guide sheet is done by a pressing jig.

17. A keypad assembly comprising:

a keypad comprising at least one protrusion having a first portion and at least one rib;

a light guide sheet comprising at least one opening that is smaller than the first portion of the at least one protrusion;

wherein the at least one protrusion comprises a first shaft having a substantially cylindrical shape with a first end, a second end and a length, the substantially cylindrical shape having a substantially constant diameter;

wherein the at least one protrusion further comprises a second shaft having a substantially tapered cylindrical shape with a first end, a second end and a length, wherein a diameter of the second shaft is tapered along the length of the second shaft starting at the first end of the second shaft and ending at the second end of the second shaft;

wherein the diameter of the first shaft is smaller than the diameter of the second shaft at the first end of the second shaft;

wherein the first end of the first shaft is attached to the keypad;

wherein the second end of the first shaft is attached to the first end of the second shaft;

wherein the at least one opening in the light guide sheet is circular;

wherein a portion of the at least one rib physically contacts at least a portion of the light guide sheet; and wherein the at least one protrusion is compressible such that the first portion of the at least one protrusion is extendable through the at least one opening in the light guide sheet.

18. The keypad assembly as in claim 17 wherein material used to make the first shaft and the second shaft is selected from a group consisting of silicone rubber and epoxy.

* * * * *